US011945671B2

(12) United States Patent
Maddalon

(10) Patent No.: US 11,945,671 B2
(45) Date of Patent: Apr. 2, 2024

(54) WINDING MACHINE FOR PRINTED SUBSTRATES

(71) Applicant: Fotoba International S.r.l., Quaregna (IT)

(72) Inventor: Valter Maddalon, Pralungo (IT)

(73) Assignee: FOTOBA INTERNATIONAL S.R.L., Quaregna (IT)

( * ) Notice: Subject to any disclaimer, the term of this patent is extended or adjusted under 35 U.S.C. 154(b) by 498 days.

(21) Appl. No.: 17/284,094

(22) PCT Filed: Oct. 10, 2019

(86) PCT No.: PCT/IB2019/058644

§ 371 (c)(1),
(2) Date: Apr. 9, 2021

(87) PCT Pub. No.: WO2020/075109

PCT Pub. Date: Apr. 16, 2020

(65) Prior Publication Data

US 2021/0347593 A1 Nov. 11, 2021

(30) Foreign Application Priority Data

Oct. 11, 2018 (IT) ..... 102018000009366

(51) Int. Cl.
*B65H 18/16* (2006.01)
*B65H 23/32* (2006.01)
*B65H 29/00* (2006.01)

(52) U.S. Cl.
CPC ..... *B65H 29/008* (2013.01); *B65H 18/16* (2013.01); *B65H 23/32* (2013.01);
(Continued)

(58) Field of Classification Search
CPC ..... B65H 18/16; B65H 19/2269; B65H 19/2276; B65H 23/32; B65H 2301/522; B65H 2301/44331
See application file for complete search history.

(56) References Cited

U.S. PATENT DOCUMENTS 3,250,484 A * 5/1966 Fair ..... B65H 18/16 242/541.2
3,850,381 A * 11/1974 Moore ..... B65H 19/2276 242/541.2

(Continued)

FOREIGN PATENT DOCUMENTS

IT 1423665 B 8/2016
JP H06107367 A 4/1994

OTHER PUBLICATIONS

International Search Report and Written Opinion for Corresponding International Application No. PCT/IB2019/058644 (13 Pages) (dated Feb. 5, 2020).

*Primary Examiner* — Sang K Kim
(74) *Attorney, Agent, or Firm* — Lucas & Mercanti, LLP

(57) ABSTRACT

This disclosure relates to a winding machine which has a plurality of equi-rotating rolls, at least two guide elements arranged mirror-wise, between which the sheets to be rolled up pass, with arched distal portions arranged in a mirror-like manner, the two guide elements being connected to a support configured to position in a mutually exclusive manner only one guide element at a time in the rolling space defined between the winding rollers. Moreover, the winding machine is equipped with a motor unit controlled so as to rotate the winding rollers in a direction or in the opposite direction depending on which of the two guide elements has its respective distal portion facing the rolling space.

4 Claims, 6 Drawing Sheets

(52) U.S. Cl.
CPC ..... *B65H 2301/44331* (2013.01); *B65H 2301/522* (2013.01); *B65H 2404/6112* (2013.01); *B65H 2701/11312* (2013.01)

(56) References Cited

U.S. PATENT DOCUMENTS 5,184,788 A * 2/1993 Schenk ..... B65H 27/00
242/541.2
2017/0123364 A1 5/2017 Kobayashi

* cited by examiner

WINDING MACHINE FOR PRINTED SUBSTRATES

CROSS-REFERENCE TO RELATED APPLICATIONS

This application is a 371 of PCT/IB2019/058644, filed Oct. 10, 2019, which claims the benefit of Italian Patent Application No. 102018000009366, filed Oct. 11, 2018.

TECHNICAL FIELD

The present disclosure relates to machines for winding sheets of paper and more particularly to a winding machine for printed substrates, such as for example sheets of large-sized paper, on themselves without a rigid base roll, configured to determine the direction of winding.

TECHNOLOGICAL BACKGROUND

Machines are known in the sector for winding large sheets of paper, such as posters. They can be made for example by means of a cylindrical drum with a radial slit, into which to insert an edge of the poster to be winded, which is made to rotate around its axis by an electric motor.

This machine is simple to use, but requires some manual practice by the operator who has to insert the edge of the poster into the slit without damaging it. Furthermore, the wound poster will be undesirably folded at the edge inserted in the slit. Moreover, since the sheets of paper tend to retain their shape when they are bent too much or even folded, it is preferable to wind the poster with the printed part facing outwards. Consequently, the operator must manually orient the poster so that it is always wound in the desired way.

A winding machine based on a different mechanism is the machine disclosed in the Italian patent IT1423665 in the name of the same Applicant and illustrated in FIG. 1. It substantially comprises a rolling unit 130 having four equi-rotating winding rollers 131 arranged downstream of the feeding path 120. The rollers 131 define between themselves a space for rolling up the sheet of paper and are configured to grip a leading edge of the printed poster 210, so as to wind it on itself to form a roll 300 inside of the rolling space.

FIG. 2 shows a profile view of a known winding machine, with the four rollers 1, 1', 2, 2', and a guide element 4, for example realized by means of a guiding plate 4 fixed to (or, as in shown, integral with) a support 3 rigidly connected to the frame of the machine. In the known winding machine of FIG. 2, the sheet of paper to be wound slides over the back of the guiding plate 4 and is guided into the rolling space so as to be gripped by the upper roller 1'. Assuming that the rollers 1, 1', 2, 2' rotate clockwise, the sheet of paper is wound in an anti-clockwise direction. The distal portion of the guiding plate 4 is shaped with an arched distal fin directed downwards to guide the leading edge of the sheet and to facilitate rolling.

SUMMARY

Even if this winding machine is effective, the Applicant believes that it can be modified to further improve productivity. Indeed, the operator must take care that the printed posters are all oriented in the same direction when fed to the winding machine because the winding machine of FIG. 2 can wind sheets of paper only in one direction, precisely in the direction (counterclockwise in figure) opposite to the direction of rotation of the equi-rotating rollers. This is also due to the fact that the known winding machine uses a single unidirectional electric motor to move both the feed rollers, which drag the sheets to be rolled forward, and the equi-rotating rollers rolls which roll the sheets onto themselves.

To overcome this limitation, a winding machine has been made as defined in claim 1. It substantially has a plurality of equi-rotating rolls, at least two guide elements arranged mirror-wise, between which the sheets to be rolled up pass, with arched distal portions arranged in a mirror-like manner, the two guide elements being connected to a support configured to position in a mutually exclusive manner only one guide element at a time in the rolling space defined between the winding rollers. Moreover, the winding machine is equipped with a motor unit controlled so as to rotate the winding rollers in a direction or in the opposite direction depending on which of the two guide elements has its respective distal portion facing the rolling space.

The claims as filed are an integral part of this description and are incorporated herein by reference.

DETAILED DESCRIPTION

Figure 1:
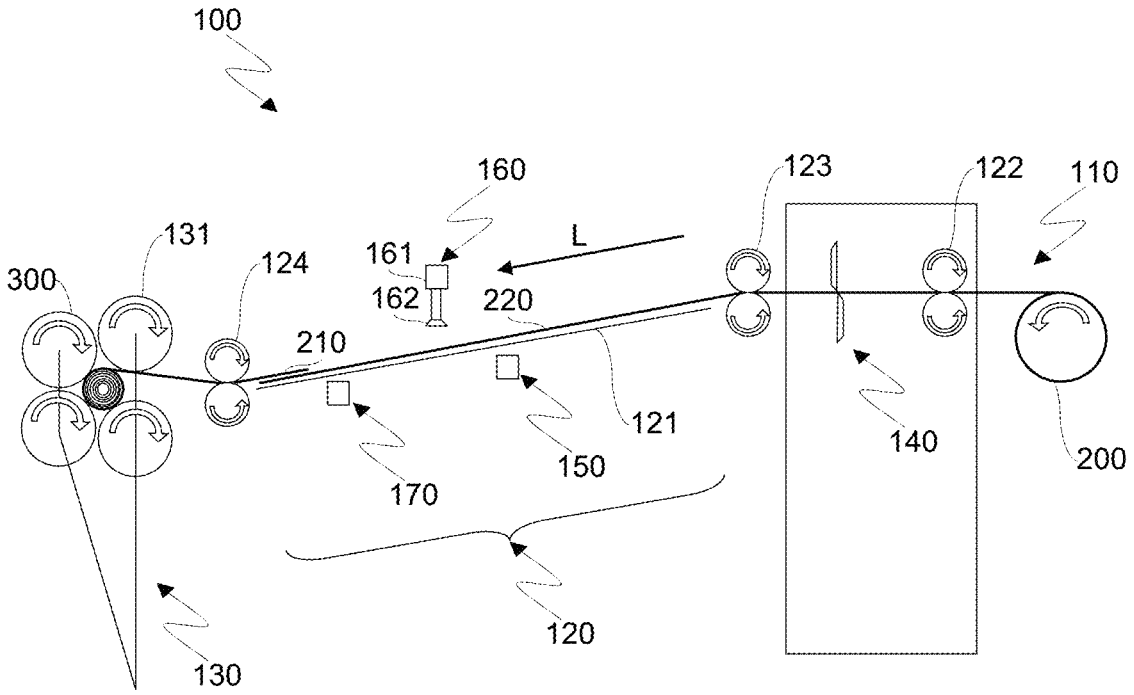
Fig.1 (prior art)
FIG. 1 shows a known winding machine.
Figure 2:
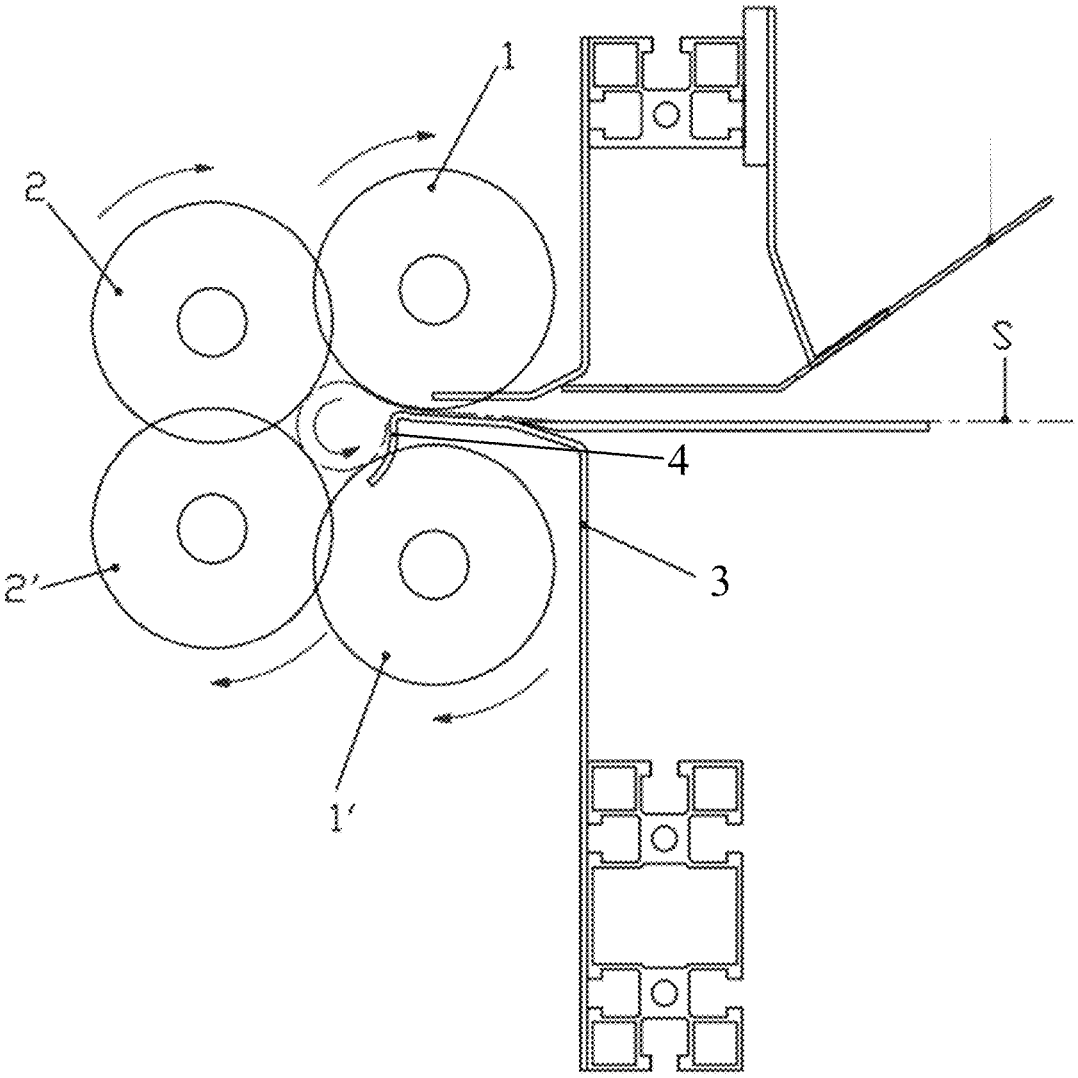
FIG. 2 (prior art)
FIG. 2 shows a partially sectional profile view of a known winding machine with an arched guiding plate facing the rolling space between the equi-rotating winding rollers.
Figure 3:
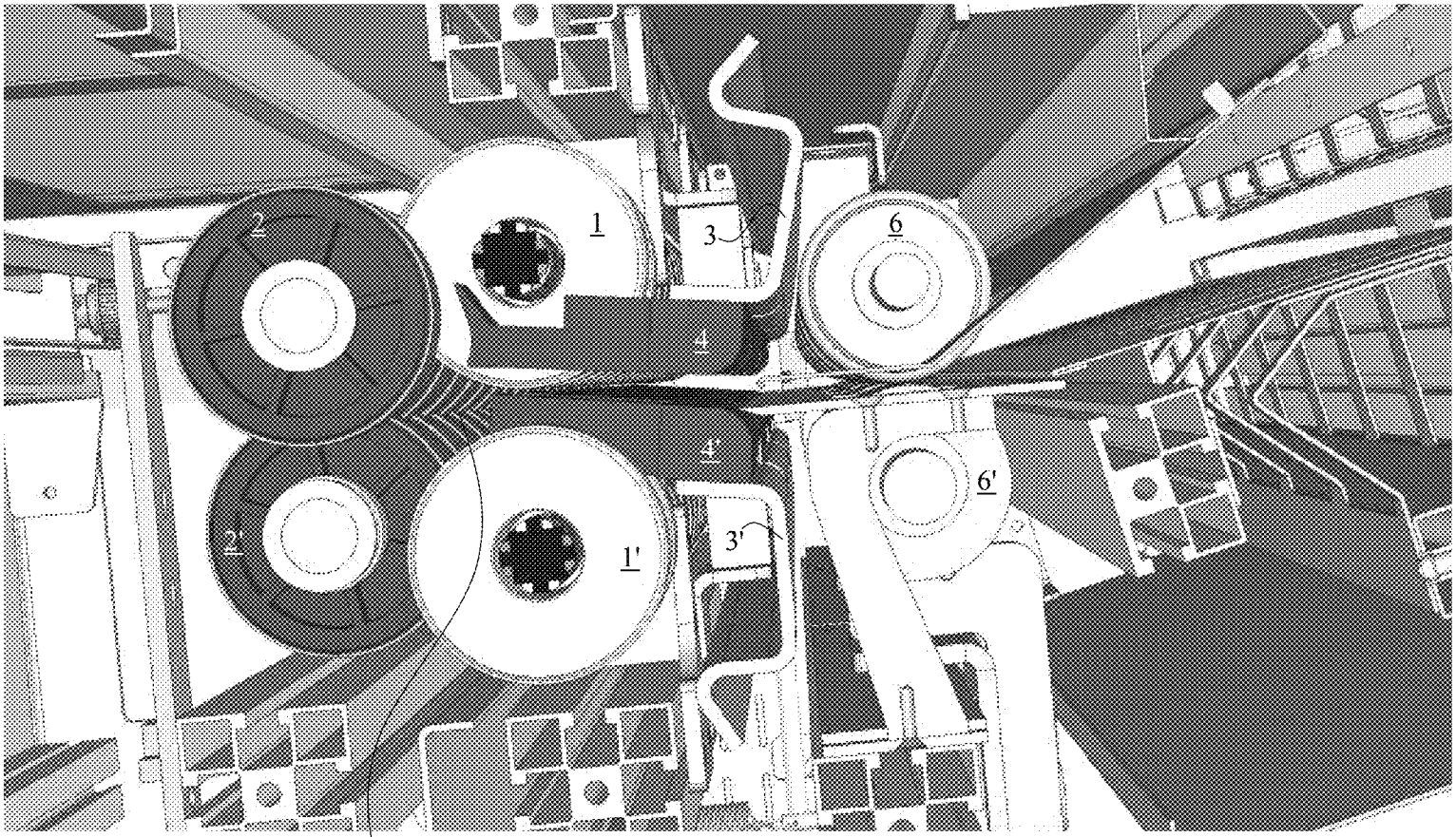
FIG. 3 shows a winding machine of the present disclosure with two rows of guiding combs arranged mirror-wise.

A winding machine according to an embodiment of the present invention is shown in FIG. 3. It differs in different respects from the known machine of FIG. 2.

First of all, the winding machine of the present disclosure has two guide elements 4 and 4', each terminating with a respective distal arched portion 4*a*. The arched portions 4*a* are placed mirror-like to one another, so as to guide the winding of a sheet of paper S, or more generally of any printed substrate S, in one direction or in the opposite direction, respectively. Furthermore, the guide elements 4 and 4' are mounted so as to be placed in a first configuration in which the arched distal end 4*a* of the first guide element 4 faces the rolling space R and the distal arched end of the second guide element 4' is outside of it, and in a second configuration, which is that shown in FIG. 3, in which the arched distal end 4*a* of the second guide element 4' is placed in the rolling space R between the rollers and the arched distal end of the first guide element 4 is outside of it.

In the embodiment shown in FIG. 3, the two guide elements 4 and 4' are two opposite rows of identical combs 4, 4', which facilitate the winding of a sheet, arranged so that the respective arched portions 4*a* are specular to each other. Specifically, a row of combs 4' has the respective arched portions 4*a* oriented to facilitate the rolling up of sheets in a counter-clockwise direction, and the other row of combs 4 has the respective arched portions 4*a* (which in FIG. 3 are outside the rolling space) arranged to facilitate rolling up in a clockwise direction.

Figure 4:
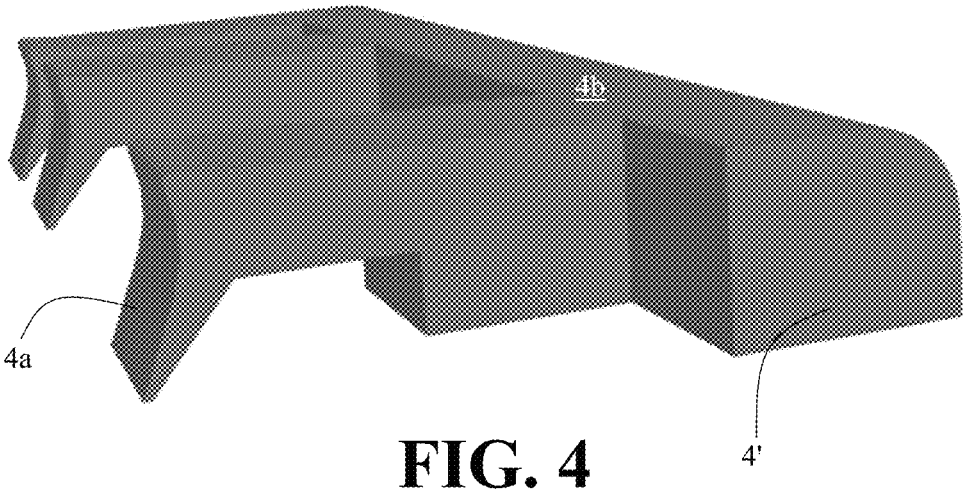
FIG. 4 shows a guiding comb with an arched distal end for guiding a leading edge of a wound sheet of paper.

FIG. 4 shows an example of a comb 4 which can be used to make the rows of combs in the machine of FIG. 3. It is shaped so as to define a back 4*b* on which the sheets to be rolled slide, and teeth which terminate with arcuate distal portions 4*a* to guide the rolling up of the printed substrate S.

According to one aspect, the two opposite rows of combs 4, 4' are fixed to respective supports 3, 3' movable with respect to the frame of the winding machine, and are configured so that the arched portions of a single row of combs 4, 4' at a time can appear in the rolling space R between the rollers 1, 1', 2, 2'.

Figure 5:
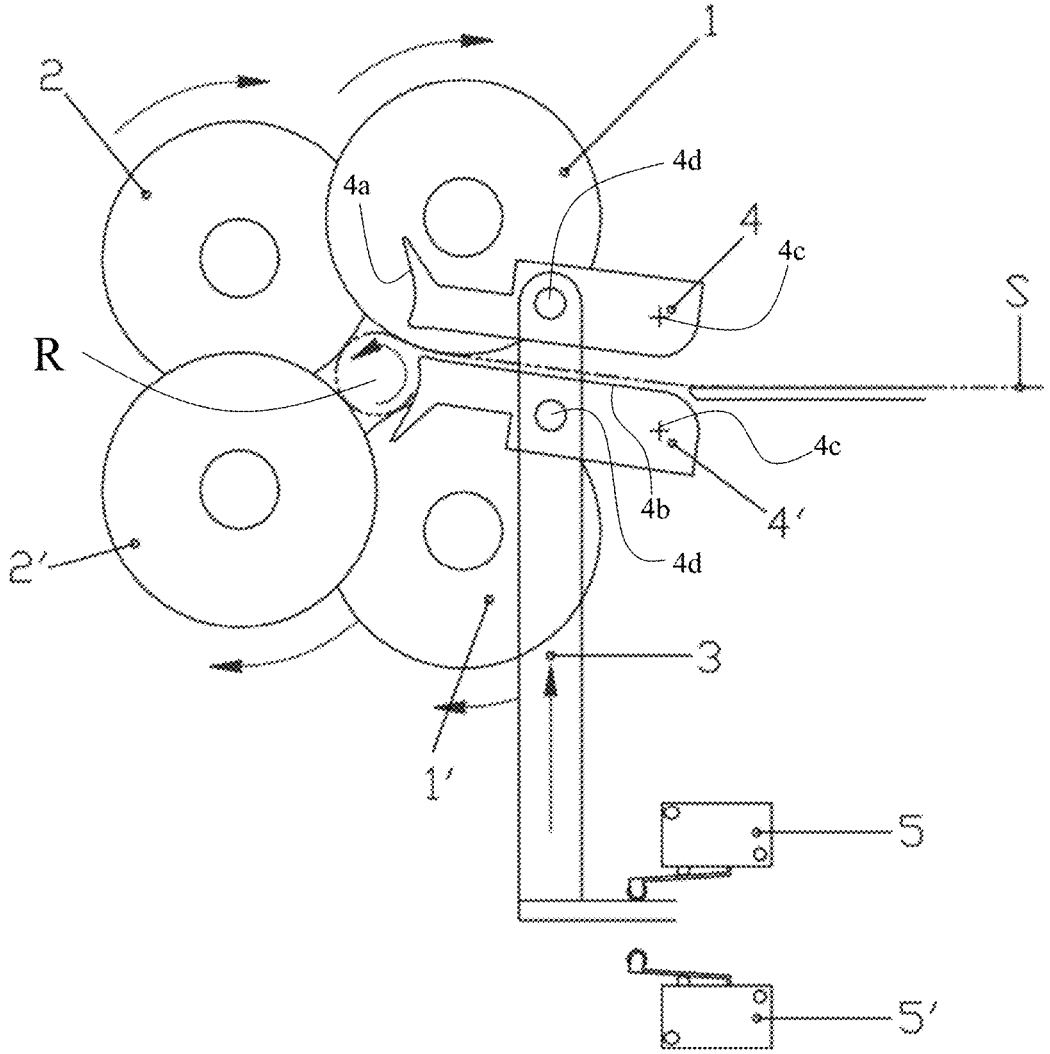
FIG. 5 is a schematic diagram of the machine of FIG. 3 configured to roll up a sheet of paper in a counter-clockwise direction.
Figure 6:
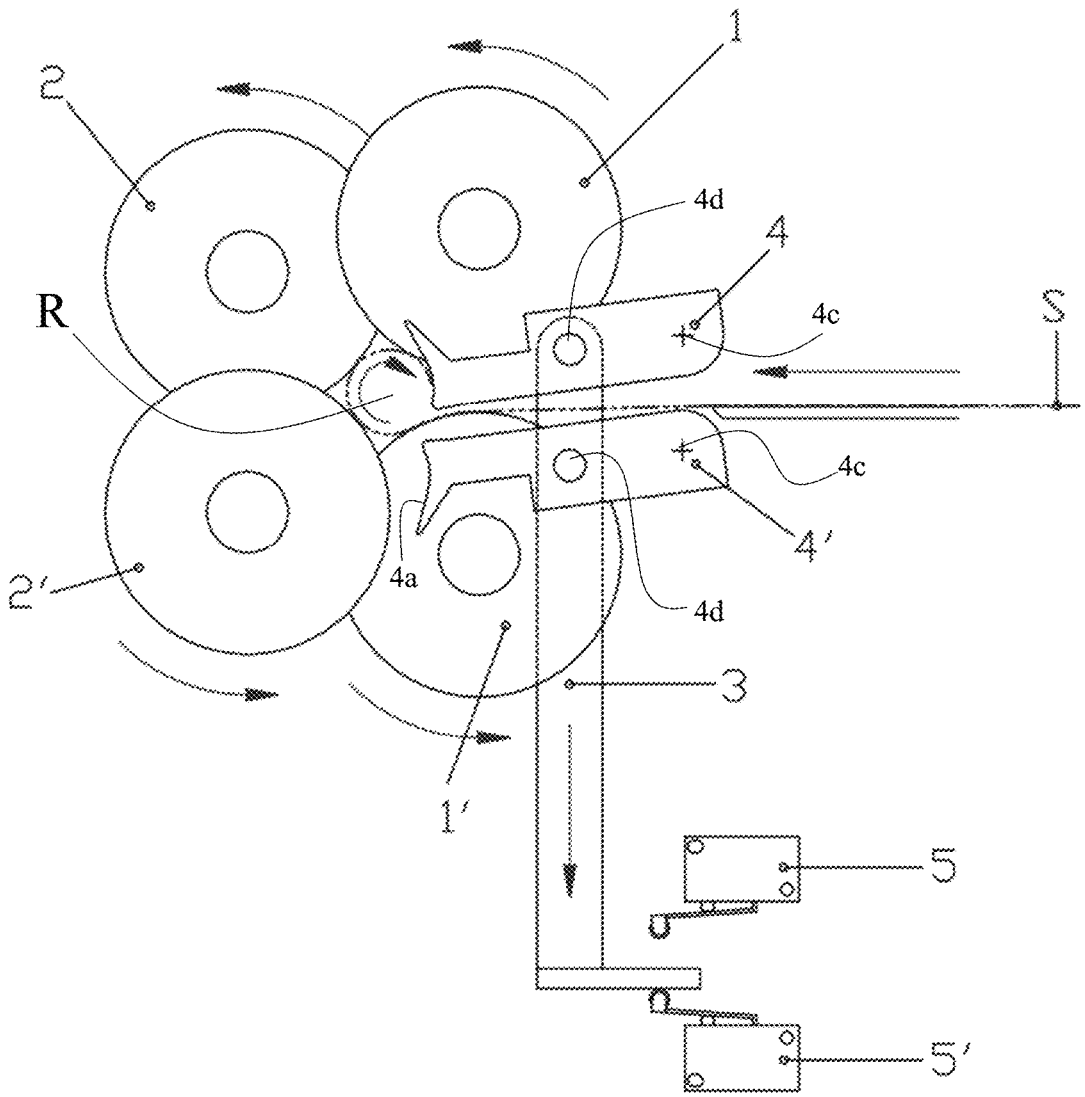
FIG. 6 is a schematic diagram of the machine of FIG. 3 configured to roll up a sheet of paper in a clockwise direction.

According to one aspect, as shown in the schematic profile views of FIGS. 5 and 6, the two guide elements 4. 4' are constrained to a single support 3, so that by moving the support 3 up or down relative to the frame of the winding machine the arched portion 4*a* of a single guide element (or a single row of combs) 4' or 4 at a time faces the rolling space R between the rollers 1, 1', 2, 2'.

To be able to wind the sheets of paper clockwise or counterclockwise, the winding machine has a motor unit (not shown) dedicated for rotating the rollers 1, 1', 2, 2' counterclockwise or clockwise, respectively. According to one aspect, the winding machine of this disclosure has two distinct electric motors (not shown): a first motor configured to rotate the rollers 1, 1', 2, 2' in a clockwise direction (FIG. 5), and a motor to rotate the rollers 1, 1', 2, 2' in an anti-clockwise direction (FIG. 6).

According to another aspect, the winding machine has only one dedicated electric motor for rotating the rollers 1, 1', 2, 2', controlled so as to be able to invert the direction of travel on command of the operator.

To activate the motor unit so as to rotate the rollers 1, 1', 2, 2' in the desired manner and position the corresponding row of combs 4, 4' between the rollers 1, 1', 2, 2' with the arched portion in the rolling space, the winding machine of this disclosure will have two switches 5 and 5' which interact with an electrical contact connected to the support 3. Lifting the support 3, the arched part of the lower guide element (or of the lower row of combs) 4' is brought in the rolling space, the upper guide element (or the upper row of combs) 4 is raised so that it does not interfere with the rolling of the sheet, at the same time closing a first switch 5 which activates the electric motor (or one of the two electric motors) of the machine so as to rotate the rollers 2 clockwise (as in the figure). In this case, the sheet of paper to be rolled up slides on the upper back 4*b* of the lower guide element (or of the lower row of combs) 4 'and is guided towards the upper winding roller 1, which cooperates with the other winding rollers 2, 2', 1' and with the arched distal portion 4*a* of the lower guide element (or of the lower row of combs) 4' to wind it counterclockwise.

When the sheet is to be wound in the opposite direction, the operator moves the support 3 so as to lower the upper guide element (or the upper row of combs) 4 moving at the same time the distal arched part 4*a* of the lower guide element (or of the lower row of combs) 4' outside the rolling space between the rollers 1, 1', 2, 2'. In this way, the other switch 5' is closed and the motor unit of the winding machine is activated so as to invert the direction of rotation of the rollers 1, 1', 2, 2'. The sheet of paper S by gravity will rest on the lower winding roll 1' (FIG. 6), which draws it into the rolling space and, cooperating with the rollers 2', 2, 1 and the arched part 4*a* of the upper guide element (or of the upper row of combs) 4, will roll it clockwise.

According to one aspect of the present disclosure, the combs 4, 4' of the two opposite rows are pivoted at respective rotation axes 4*c*, 4'*c* fixed with respect to the frame of the machine, and are driven by the mobile support 3 (or by the respective supports 3, 3' as in FIG. 3) by means of the pins 4*d*, 4'*d*, which are at a distance from the rotation axes 4*c*, 4'*c*, so as to be alternatively positioned in the rolling space by rotating around the axes 4*c*.

With the winding machine of this disclosure, the operator is no longer obliged to manually turn the sheets to be rolled up, but must simply move the support (or the supports 3, 3') so as to close that switch, between the switches 5 and 5', which causes the rollers 1, 1', 2, 2' to rotate in the desired direction.

Moreover, the winding machine can be equipped with a scanner (not shown), facing the upper face of the printed substrate fed to the machine, functionally connected to a control unit (not shown in the figures). When the winding machine is in operation, the control unit detects through the scanner whether the substrate being fed has the printed side facing upwards or downwards and, through actuators acting on the support 3 (or on the supports 3, 3'), controls the rotation of the winding rolls 1, 1', 2, 2' in one direction or the other. Consequently, the rolling operation becomes fully automatic so that the winding machine of this disclosure can be used in totally automated lines for the production of large printed sheets of paper, which perform printing, cutting and final rolling up of the sheets.

The invention claimed is:

1. A winding machine for printed substrates, comprising:

a plurality of motorized equi-rotating rollers configured to receive a leading edge of a printed substrate, for dragging it in a rolling space defined between the motorized equi-rotating rolls and winding it on itself in the rolling space to form a roll;

a support;

a first guide element of the printed substrate, constrained to said support, shaped so as to define a supporting surface to support the printed substrate as it advances toward the motorized equi-rotating rollers and a distal arched end to guide the leading edge in order to wind the printed substrate on itself;

a second guide element tied to said support, having a respective distal arched end shaped as said first distal arched end and arranged in a mirror image thereto;

wherein said support is movable between a first configuration, in which the distal arched end of the first guide element is placed in said rolling space and in which the distal arched end of the second guide element is outside said rolling space, and a second configuration, wherein the distal arched end of the second guide member is located in said rolling space and wherein the distal arched end of the first guide element is outside said rolling space;

an electric control switchable between a first state, when said support is in the first configuration, and a second state, when said support is in the second configuration, wherein said electric control is configured to switch said motor unit to rotate the motorized equi-rotating rollers counterclockwise when in the first state and clockwise when in the second state.

2. The winding machine according to claim 1, in which:

said first guiding element comprises a plurality of identical combs each having said supporting back and a plurality of teeth, each tooth of said teeth ending respectively with said distal arched end shaped to guide the leading edge to wind the printed substrate on itself; and said second guiding element is identical with said first guiding element and is placed in a mirror image thereto.

3. The winding machine according to claim 1, in which the said electric control comprises:

a first switch configured to be closed when said support is in the first configuration and to be open when the support is in the second configuration; and a second switch configured to be closed when said support is in the second configuration and to be open when the support is in the first configuration.

4. The winding machine according to claim 1, wherein said support comprises a single crossbeam, configured to be moved from said first configuration to said second configuration and vice versa, to which said first guide element and said second guide element are connected.

* * * * *